United States Patent [19]

Tatebayashi et al.

[11] 4,284,401

[45] Aug. 18, 1981

[54] METHOD AND MEANS FOR FEEDING FUEL INTO FLUIDIZED-BED COMBUSTION APPARATUS

[75] Inventors: June Tatebayashi, Toyonaka; Kazuaki Yano, Amagasaki, both of Japan

[73] Assignee: Kawasaki Jukogyo Kabushiki Kaisha, Kobe, Japan

[21] Appl. No.: 62,532

[22] Filed: Jul. 31, 1979

[30] Foreign Application Priority Data

Aug. 3, 1978 [JP] Japan ..... 53-95087
Apr. 26, 1979 [JP] Japan ..... 54-51831

[51] Int. Cl.[3] ..... F23D 19/02

[52] U.S. Cl. ..... 431/7; 431/144; 422/139; 422/143; 432/15; 432/58

[58] Field of Search ..... 431/7, 170, 326, 144; 122/4 D; 432/15, 58; 422/139-143; 110/245; 34/57 R, 57 A; 239/185, 186

[56] References Cited

U.S. PATENT DOCUMENTS 3,277,582 10/1966 Munro et al. ..... 422/143
4,165,040 8/1979 Beacham et al. ..... 431/170

*Primary Examiner*—James C. Yeung
*Assistant Examiner*—Robert J. Marett
*Attorney, Agent, or Firm*—Haseltine & Lake

[57] ABSTRACT

A bed of solid particles on an air distributor of a fluidized-bed furnace is fluidized by upward currents of air fed through the distributor. A fuel to be burnt in the fluidized bed is premixed with carrying air, and the fuel-air mixture is fed into the bed from a burner extending upwardly through the distributor. For utmost combustion efficiency the ratio by mass of the feed rate of the fuel-carrying air to the sum of the feed rates of the fuel-carrying air and the bed-fluidizing air is adjusted by flow control valves so as to be in the range of from about 0.2 to 0.6. The head of the burner is of such construction that the fuel-air mixture is ejected therefrom in the form of swirling jets. The burner head is usually located about 50 millimeters above the distributor.

6 Claims, 14 Drawing Figures

METHOD AND MEANS FOR FEEDING FUEL INTO FLUIDIZED-BED COMBUSTION APPARATUS

BACKGROUND OF THE INVENTION

This invention relates to combustion apparatus such as furnaces and boilers, and in particular to fluidized-bed combustion apparatus in which combustion takes place in a bed of noncombustible solid particles while the same is being "fluidized" or made to behave in a fluid-like manner by rising streams of air. More particularly, the invention pertains to a method of, and means for, introducing a fuel into the fluidized bed of such combustion apparatus.

In a fluidized-bed furnace for the incineration of sewage sludges and heat-producing industrial wastes such as pitch, sludge, and waste oil, for example, the fuel to be burnt is fed into the fluidized bed, as of quartz sand or pulverized limestone, from burners of various constructions and arrangements. The fuel may be either the heat-producing waste itself, heavy oil, light oil, finely divided coal or coke, natural or manufactured gas, or coal/oil mixtures among other materials.

An example of burners heretofore employed for the above purpose is the gun burner, which sprays a liquid fuel into the fluidized bed for diffusion combustion. The gun burner has the drawback of readily overheating, resulting in the thermal cracking of the fuel and in the consequent accumulation of carbon to the point of clogging up the burner nozzle. The noted problem is absent from another known burner which atomizes the injected fuel by high pressure air. This and other similar prior art burners, however, aim mostly at successful introduction of the fuel into the fluidized bed, rather than at the most efficient combustion in the fluidized bed.

SUMMARY OF THE INVENTION

It is a general object of this invention to improve the combustion efficiency of fluidized-bed combustion apparatus by the provision of an improved method of, and means for, feeding a fuel into the fluidized bed of the apparatus.

According to one aspect of the invention there is provided a method of supplying a fuel into a fluidized-bed combustion apparatus of the type having a bed of solid particles formed on an air distributor. The method comprises feeding fluidizing air into the bed through the distributor to fluidize the bed and simultaneously feeding a mixture of the fuel and fuel-carrying air into the fluidized bed. The ratio by mass of the feed rate of the fuel-carrying air to the sum of the feed rates of the fluidizing air and the fuel-carrying air is adjusted to be in the range of from about 0.2 to about 0.6.

Another aspect of the invention concerns the improved construction of the fluidized-bed combustion apparatus for use in the practice of the above summarized method. The apparatus comprises an enclosure having a distributor, a bed of solid particles overlying the distributor, means for feeding fluidizing air into the bed through the distributor to fluidize the bed, means for controlling the feed rate of the fluidizing air, a burner for feeding a mixture of a fuel and fuel-carrying air into the bed, and means for controlling the feed rate of the fuel-carrying air.

The invention is based upon the discovery that for maximum combustion efficiency, the intermixing of fuel and air must be promoted within the fluidized bed, particularly at and adjacent the point of injection of the fuel. This objective requires an increase in the feed rate of the fuel-carrying air. Since the fuel-carrying air need not act to atomize the fuel in accordance with the invention, the air pressure can be comparatively low. The feed rate of the fuel-carrying air can therefore be increased as desired.

Experiments have proved, however, that the increase in the feed rate of the fuel-carrying air results in a decrease in the concentration of carbon monoxide (CO) emission from the combustion apparatus but in an increase in the concentration of nitrogen oxides (NOx) emitted. The mass ratio of the feed rate of the fuel-carrying air to the sum of the feed rates of the fuel-carrying air and the fluidizing air is specified as being in the range of from about 0.2 to about 0.6, as above, because in this range the concentrations of CO and NOx emissions are both relatively low.

It is also important for high combustion efficiency that the fuel-air mixture be introduced into the fluidized bed in a manner facilitating its diffusion through the bed. The invention therefore suggests the use of a burner head such that the fuel-air mixture is injected into the fluidized bed in the form of swirling jets.

The height of the point of injection of the fuel-air mixture into the fluidized bed, as measured from the distributor, is also an important factor of combustion efficiency. This is because the behavior of the fluidized bed varies with the distance from the distributor. The fuel-air mixture should be injected from a height such that the fuel will burn most effectively. Experiments have shown that this height is normally about 50 millimeters.

The above and other objects, features and advantages of this invention and the manner of attaining them will become more readily apparent, and the invention itself will best be understood, from the following description and appended claims taken in connection with the accompanying drawings.

DETAILED DESCRIPTION OF THE INVENTION

Figure 1:
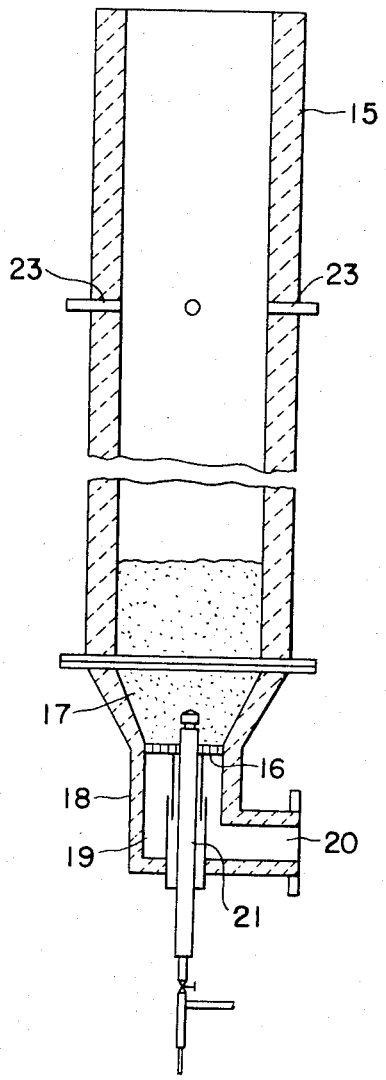
FIG. 1 is an elevation, in vertical section, partly broken away, of a fluidized-bed furnace or incinerator incorporating the novel concepts of this invention.
Figure 2:
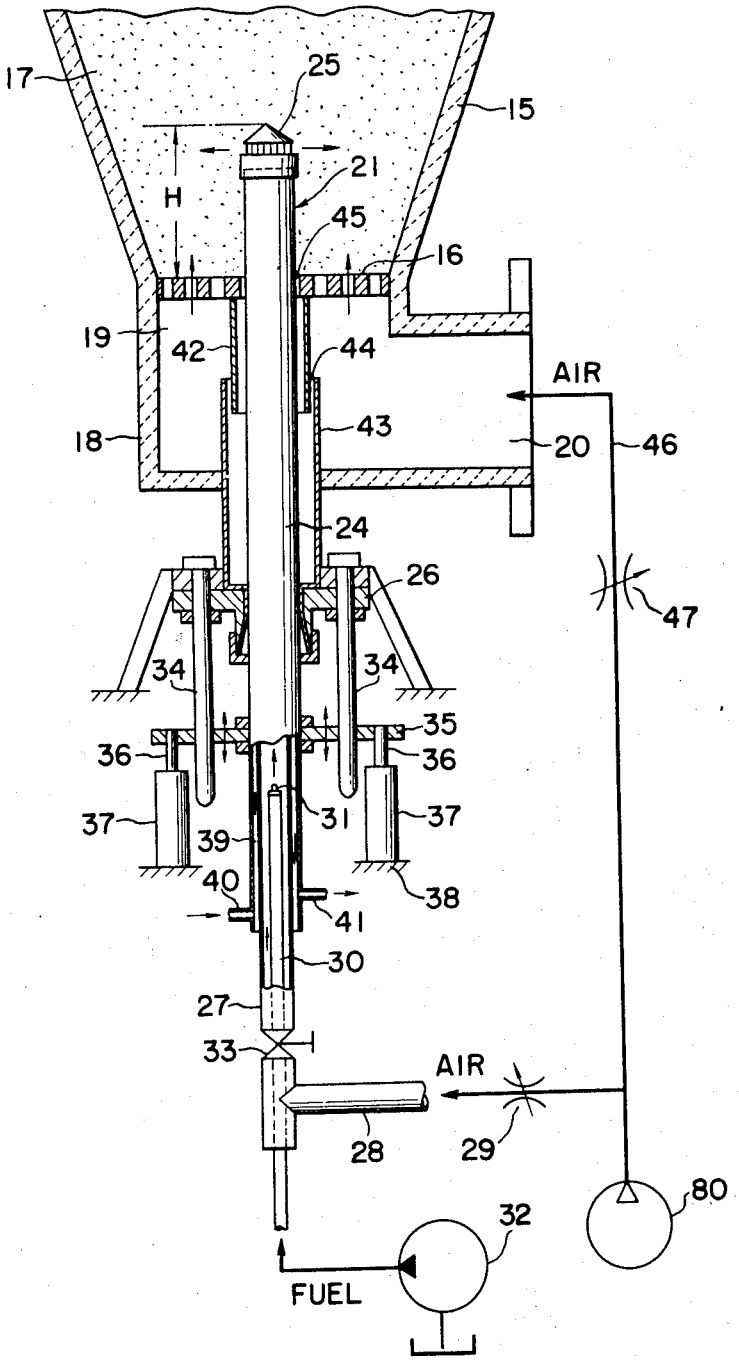
FIG. 2 is a relatively enlarged elevation, in vertical section, partly in the form of a flow chart, of the fluidized-bed furnace of FIG. 1, the view showing in particular the burner assembly and means associated therewith.

FIGS. 1 and 2 of the drawings show the invention as adapted for a fluidized-bed furnace for the incineration, for example, of waste oil or the like which itself serves as a fuel, and of sewage sludge or other matter that requires a fuel for combustion. With reference first to FIG. 1, the fluidized-bed furnace includes a generally upright enclosure 15 having an air distributor 16. A bed 17 of noncombustible solid particles overlies the distributor 16. The solid particles forming the bed 17 may be quartz sand or ash, for example, or may be prepared from a desulfurizing agent such as limestone or dolomite. The depth of the bed 17 usually ranges from 700 to 1500 millimeters (mm).

A part of the furnace enclosure 15 defines a plenum chamber 19 under the distributor 16. Currents of air under pressure are introduced from the plenum chamber 19 into the bed 17 through the distributor 16 to fluidize the bed. The bed 17 is therefore termed a fluidized bed. The plenum chamber 19 has an inlet opening 20 for reception of the fluidizing air.

Extending vertically through the plenum chamber 19 and projecting into the fluidized bed 17 through the distributor 16 is a burner assembly 21 for delivery of a fuel, premixed with carrying air, into the fluidized bed. The burner assembly 21 is movable up and down to adjustably vary the length of its portion projecting beyond the distributor 16. The burner assembly 21 and means associated therewith will be detailed later with reference to FIG. 2.

The furnace enclosure 15 has a suitable means not shown through which sludge or other matter to be incinerated is fed into the furnace and onto the fluidized bed 17. Waste oil or the like which is to be incinerated but which itself serves as a fuel may be introduced into the furnace through the burner assembly 21. The materials thus fed into the furnace undergo a rapid process of combustion by being agitated by and mixed with the fluidized bed 17. Also formed in the furnace enclosure 15 are a plurality of secondary air inlets 23 through which preheated secondary air is forced into the furnace to complete the combustion.

As shown in more detail in FIG. 2, the burner assembly 21 generally comprises a tubular stem 24 slidably extending through the distributor 16 and a burner head 25 fixedly but replaceably mounted on the top end of the stem projecting into the fluidized bed 17. The structural details of the burner head 25 will become apparent from the ensuing description of FIGS. 3 and 4.

The tubular burner stem 24 extends downwardly through the bottom of the plenum chamber 19 and further slidably through a stationary guide structure 26 suitably mounted under the furnace enclosure 15. The burner stem 24 at its bottom end portion is telescopically fitted over an open-ended fuel-carrying air conduit 27 and is so placed in direct communication therewith. The fuel-carrying air conduit 27 has a branch conduit 28 communicating with a blower 80 via a flow control valve 29. Coaxially received within the fuel-carrying air conduit 27 with considerable clearance is a fuel conduit 30 having a nozzle tip 31 on its top end. The fuel conduit 30 projects out of the closed bottom end of the fuel-carrying air conduit 27 and communicates with a fuel pump 32 or equivalent means.

Thus, on issuing from the nozzle tip 31, the pumped fuel intermingles with the carrying air under pressure from the conduit 27. The fuel-air mixture travels upwardly through the burner stem 24 and is charged into the fluidized bed 17 from the burner head 25 in the manner yet to be described. An on-off valve is provided at 33 to open and close the fuel-carrying air conduit 27 and the fuel conduit 30 as required.

A plurality of guide rods 34 extend downwardly from the noted guide structure 26. Slidably engaged with these guide rods 34 is a flange 35 fixedly mounted on the burner stem 24. The flange 35 is secured to the piston rods 36 of fluid actuated cylinders 37 mounted uprightly on some stationary part 38.

With the extension and contraction of the piston rods 36, therefore, the burner stem 24 together with the burner head 25 thereon travels up and down relative to the furnace proper, resulting in the change in the height H of the burner head as measured from the distributor 16. The purposes of thus varying the height H of the burner head 25 will be later referred to.

The burner stem 24 is of double wall construction to provide a cooling water jacket 39. The jacket 39 has an inlet 40 for ingress of cooling water and an outlet 41 for egress of the used water.

Within the plenum chamber 19 a sleeve 42 loosely surrounds the burner stem 24 and at its top end is secured to the distributor 16. Another sleeve 43 of greater diameter, supported by the bottom of the plenum chamber 19 and by the guide structure 26, also loosely surrounds the burner stem 24 and the bottom end portion of the first recited sleeve 42. Besides passing through the distributor 16, the fluidizing air in the plenum chamber 19 enters the sleeves 42 and 43 through the gap 44 therebetween and further passes through the clearance 45 between the distributor 16 and the burner stem 24. The fluidized bed particles are thus prevented from falling into the clearance 45.

As further shown in FIG. 2, a fluidizing air conduit 46 delivers fluidizing air from the blower 80 into the plenum chamber 19. The fluidizing air conduit 46 has a flow control valve 47 for adjustment of the delivery rate of the fluidizing air into the plenum chamber 19.

Figure 3:
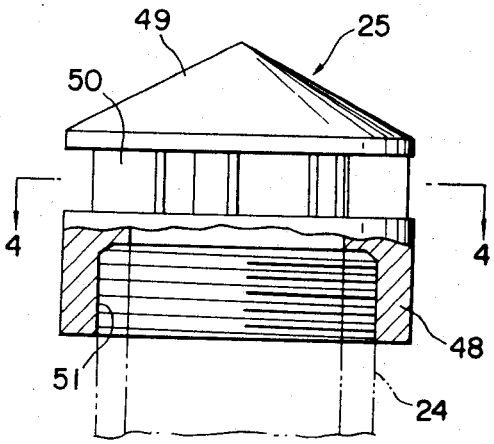
FIG. 3 is a further enlarged, elevation, partly in axial section, of the head of the burner assembly shown in FIG. 2.
Figure 4:
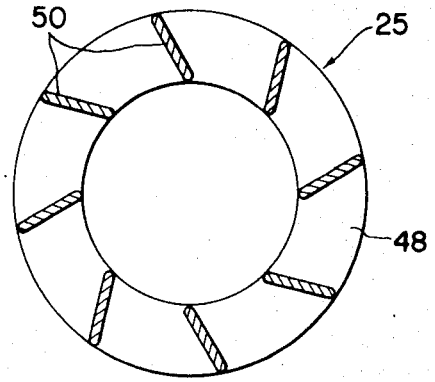
FIG. 4 is a sectional view taken along the line 4—4 of FIG. 3 as viewed in the arrow direction.

As will be seen from its enlarged views given in FIGS. 3 and 4, the burner head 25 comprises a hollow, cylindrical base or connector portion 48, a conical top cover 49, and a plurality of baffle plates 50 in annular arrangement extending between the base and the top cover to define lateral outlet openings for ejection of the fuel-air mixture. The hollow base 48 of the burner head 25 is internally screw threaded at 51 for engagement with corresponding external screw thread on the top end portion of the burner stem 24. This permits the burner head 25 to be readily mounted in place on, and dismounted from, the burner stem 24.

The baffle plates 50 of the burner head 25 are disposed at constant space intervals around a circle coaxial with the burner head 25, and each is oriented at a specific angle relative to the radial direction. Since all of the baffle plates 50 are so angled as viewed cross-sectionally as in FIG. 4, they act to impart a swirl to the jets of fuel-air mixture discharged from the burner head 25. The swirling jets of fuel-air mixture intimately mingle with and diffuse through the fluidized-bed particles thereby contributing toward complete combustion of desired materials. The top cover 49 of the burner head 25 serves to prevent the fluidized-bed particles from falling into the burner, particularly when the fuel-air mixture is not being delivered into the fluidized bed 17.

Figure 5:
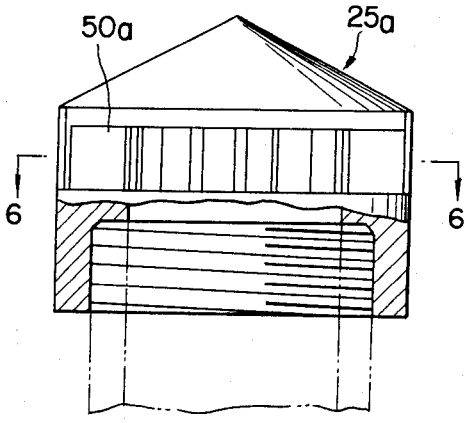
FIG. 5 is an elevation, partly in axial section, of a modified burner head for use in the burner assembly of FIG. 2.
Figure 6:
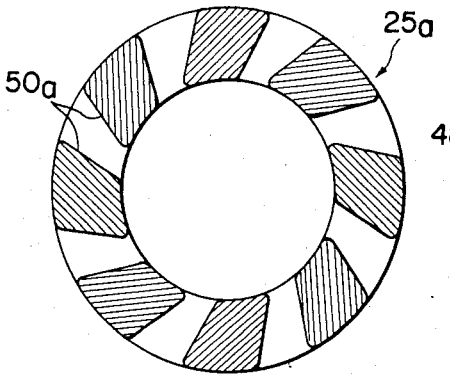
FIG. 6 is a sectional view taken along the line 6—6 of FIG. 5 as viewed in the arrow direction.

FIGS. 5 and 6 show a slight modification of the burner head 25. Generally labeled 25*a*, the modified burner head features baffle plates 50*a* of greater thickness than those of the burner head 25. The thicker baffle plates 50*a* make the outlet openings of the burner head 25*a* correspondingly smaller and so serve to give greater acceleration to the jets of fuel-air mixture leaving the burner head 25*a*.

Figure 7:
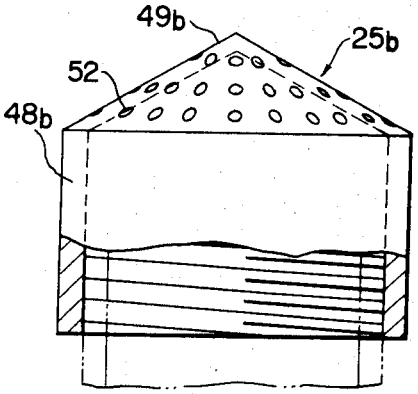
FIG. 7 is an elevation, partly in axial section, of another modified burner head.

The invention permits the use of other types of burner heads within the broad teaching thereof. FIG. 7 shows one such burner head 25*b*, which comprises a hollow, internally screw-threaded, cylindrical base 48*b*, and a conical top 49*b* directly closing the top of the cylindrical base. The conical top 49*b* has formed therein a multiplicity of holes 52 of comparatively small diameter and of suitable relative placement for the discharge of fuel-air mixture jets.

Figure 8:
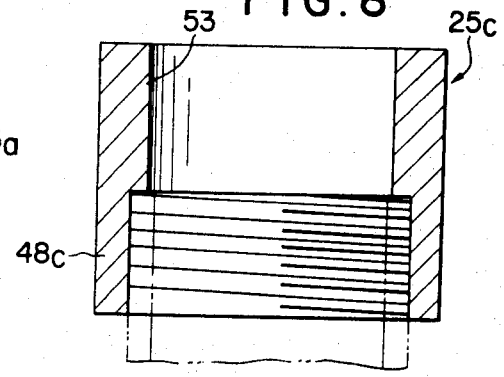
FIG. 8 is an axial sectional view of a further modified burner head.
Figure 9:
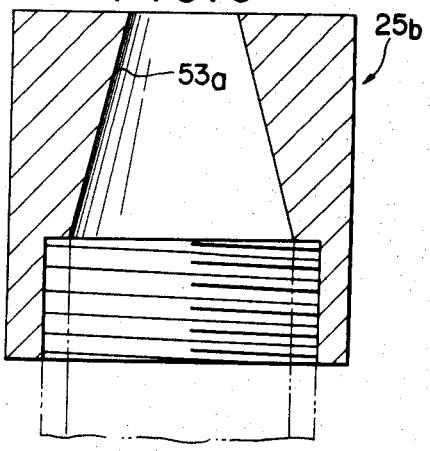
FIG. 9 is an axial sectional view of a still further modified burner head.

In FIG. 8 is shown another different type of burner head 25*c*. Generally in the form of a hollow cylinder, the burner head 25*c* at its bottom end portion is internally screw threaded to serve as a base 48*c*. The cylindrical hollow 53 in the top end portion of the burner head 25*c* serves as an outlet for ejection of the fuel-air mixture. Still another different type of burner head 25*d* shown in FIG. 9 differs from the burner head 25*c* only in that the hollow 53*a* in its top end portion tapers upwardly to accelerate the stream of fuel-air mixture passing therethrough.

In the operation of the fluidized-bed furnace of FIGS. 1 and 2, the fluidized bed 17 is fluidized by rising streams of fluidizing air from the plenum chamber 19. Simultaneously the fuel to be burnt, premixed with carrying air within the burner stem 24, is thereby transported and introduced into the fluidized bed 17 from the burner head 25. The fuel in use may be any of the materials listed earlier in this specification.

It has been found that the feed rate of the fuel-carrying air and its velocity are the primary factors that determine the length of the spouts of the fuel-air mixture issuing from the burner head, the initial gas bubble diameters within the fluidized bed, and the behavior of the gases and bed particles in the neighborhood of the burner head. High combustion efficiency results from proper agitation of the fluidized bed, particularly in the vicinity of the burner head from which the fuel is injected, and from proper diffusion of the injected fuel.

In connection with the foregoing, it has been found that for improved combustion efficiency, the rate G1 at which the fuel-carrying air is fed into the furnace should be suitably proportioned in relation to the sum Gt of G1 and the rate G2 at which the fluidizing air is fed into the furnace. Experiments were conducted to ascertain the concentrations of CO and NOx emitted by the furnace of FIGS. 1 and 2 operating at various values of the ratio G1/Gt. The concentrations of CO and NOx emissions serve as measures of the completeness of combustion.

In the experiments a mixture of quartz sand and pulverized lime was employed as the fluidized bed 17. The particle size of these materials ranged from 1.00 to 1.68 mm in diameter, and their total weight was 250 kilograms (kg). Heavy oil was used as the fuel and was introduced at a rate of 20 kg per hour. The ratio of Gt to the feed rate of air theoretically required for perfect combustion was 1.3. The temperature of the fluidized bed was 850° C. The various burner heads tested were all held at the height of 50 mm above the distributor 16.

Figure 10:
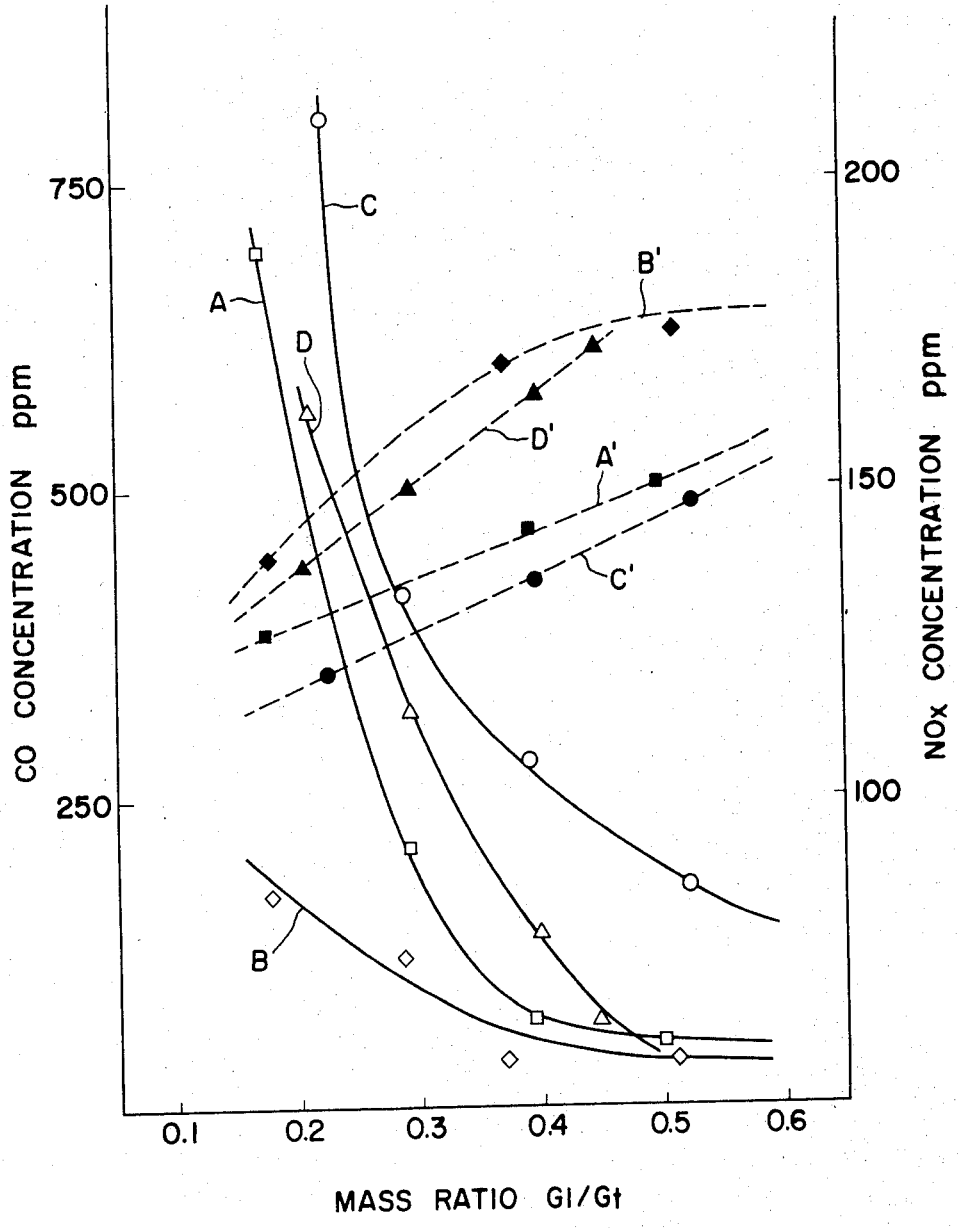
FIG. 10 is a graph plotting the curves of the concentrations of the CO and NOx emissions from the fluidized-bed furnace against the mass ratio of the feed rate of the fuel-carrying air to the sum of the feed rates of the fluidizing air and the fuel-carrying air, the different curves representing different burner heads in use.

FIG. 10 graphically represents the results of the experiments, showing plotted curves of the CO and NOx concentrations, in parts per million (ppm), against the ratio G1/Gt by mass. In the graph the curve A indicates the CO concentration characteristic of the burner head 25 of FIGS. 3 and 4, with each baffle plate 50 angled 30° to the radial direction of the head, and the curve A′ represents the NOx concentration characteristic of the same burner head. The curve B indicates the CO concentration characteristic of a similar burner head, but with each baffle plate angled 60° to the radial direction of the head, and the curve B′ indicates the NOx concentration characteristic of the same burner head. The curve C represents the CO concentration characteristic of the burner head 25*c* of FIG. 8, with its fluid outlet 53 having a diameter of 37.1 mm, and the curve C′ represents the NOx concentration characteristic of the same burner head. The curve D indicates the CO concentration characteristic of a burner head similar to the head 25*c*, but with the fluid outlet diameter reduced to 20 mm, and the curve D′ represents the NOx concentration characteristic of the same burner head.

A consideration of FIG. 10 will reveal that regardless of the kind of burner head in use, the CO concentration sharply decreases, and the NOx concentration steadily increases, with the increasing values of the ratio G1/Gt. The lower the CO and NOx concentrations, the more complete is the degree of combustion. Since the CO concentration is the more important measure of the completeness of combustion, however, the ratio G1/Gt should range from about 0.2 to about 0.6, preferably from about 0.4 to about 0.5. The fluidized-bed furnace of FIGS. 1 and 2 permits easy adjustment of this ratio by means of the flow control valve 29 on the branch 28 of the fuel-carrying air conduit 27 and the flow control valve 47 on the fluidizing air conduit 46.

The graph of FIG. 10 also indicates that, as far as the CO concentration is concerned, the burner heads of the type shown in FIGS. 3 and 4 (curves A and B) are generally preferable to those of the type shown in FIG. 8 (curves C and D). Further, the burner head of the curve B (i.e., the one with each baffle plate angled 60° to its radial direction) is preferable to the burner head of the curve A (i.e., the one with each baffle plate angled 30°).

Another important factor affecting combustion efficiency in the fluidized-bed furnace of FIGS. 1 and 2 is the height H of the burner head above the distributor 16. This is because the behaviors of the fluidized-bed particles and gases vary with the distance from the distributor 16. Experiments were carried out to find the optimum height H of the burner head from the concentrations of CO and NOx emissions of the furnace at various values of the ratio G1/Gt. In these experiments, the burner head 25 of FIGS. 3 and 4, with each baffle plate 50 angled 30° to its radial direction was employed. The depth of the fluidized bed was approximately 1,000 mm. The other conditions were the same as those of the previous experiments reported in connection with FIG. 10.

Figure 11:
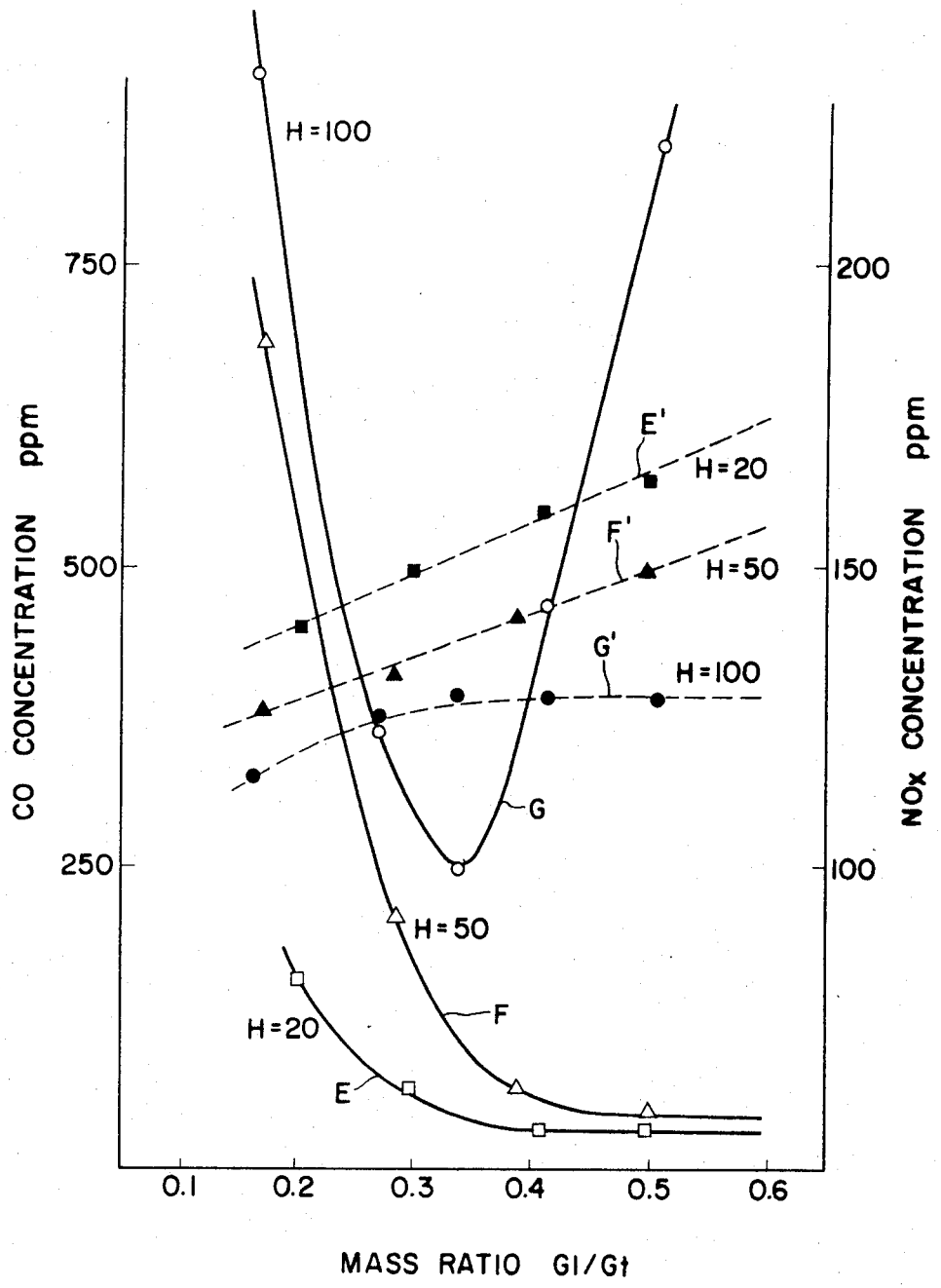
FIG. 11 is a graph also plotting the curves of the CO and NOx concentrations against the mass ratio of the feed rate of the fuel-carrying air to the sum of the feed rates of the fluidizing air and the fuel-carrying air, the different curves representing different heights of the burner head from the distributor.

FIG. 11 graphically indicates the results of the experiments, showing curves of the CO and NOx concentrations, in ppm, against the mass ratio G1/Gt. The curves E and E' in the graph indicate the CO and NOx concentration characteristics, respectively, of the burner head 25 when H is 20 mm. The curves F and F' indicate the CO and NOx concentration characteristics, respectively, when H is 50 mm. The curves G and G' indicate the CO and NOx concentration characteristics, respectively, when H is 100 mm.

When H is 20 mm, the CO concentration is the minimum (curve E), but the NOx concentration is the maximum (curve E'). When H is 100 mm, on the other hand, the NOx concentration is the minimum (curve G'), but the CO concentration is the maximum (curve G). Normally, therefore, H should be about 50 mm.

Results similar to those of the graph of FIG. 11 can be obtained if the baffle plates 50 of the burner head are set at angles other than 30°. In the fluidized-bed furnace of FIGS. 1 and 2, H is made adjustable because its precise value is subject to change depending upon the type of burner head in use and upon the heat load of the furnace and other working conditions.

Figure 12:
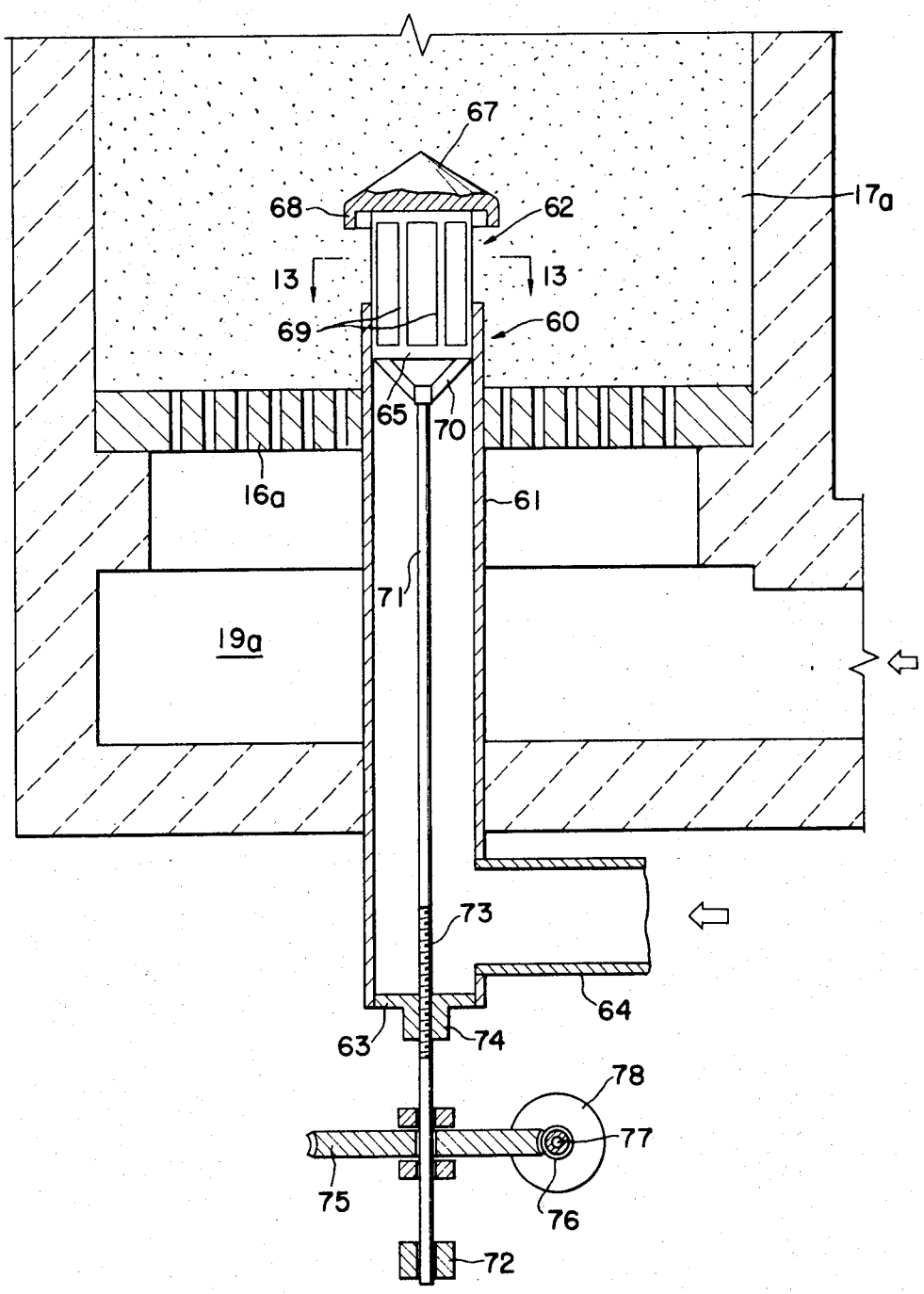
FIG. 12 is an elevation, partly in vertical section, showing in particular another preferred form of the burner assembly in accordance with the invention, the head of the burner assembly being shown in its working position.
Figure 13:
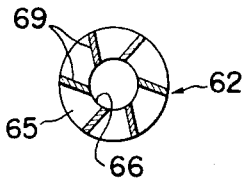
FIG. 13 is a sectional view taken along the line 13—13 of FIG. 12 as viewed in the arrow direction.
Figure 14:
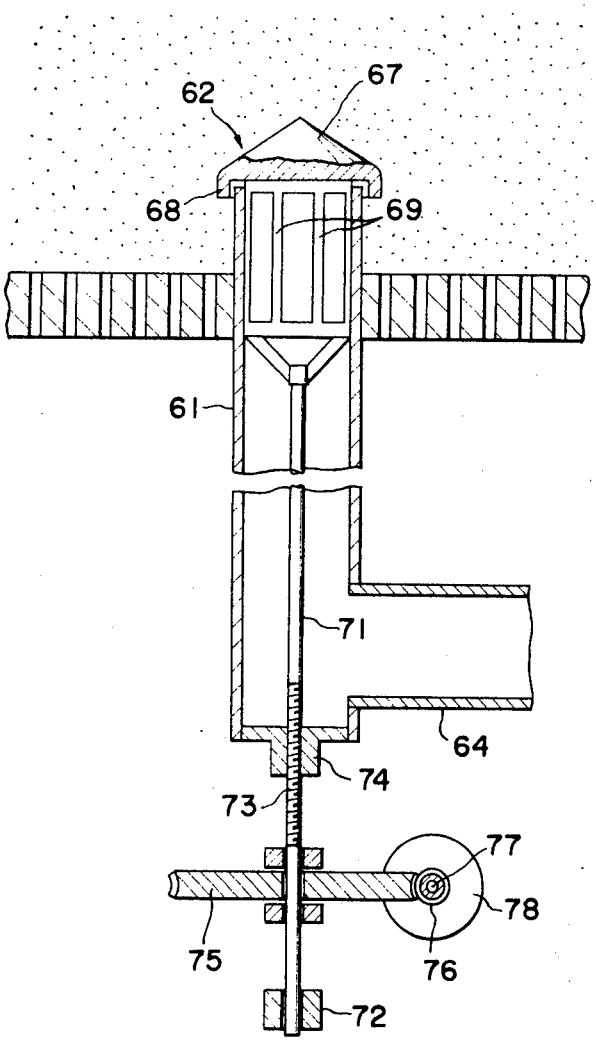
FIG. 14 is a view similar to FIG. 12 but showing the head of the burner assembly in its retracted position.

FIGS. 12, 13 and 14 show another preferred construction of fluidized-bed furnace or combustion apparatus according to this invention, including a modified burner assembly 60 and associated means. The other parts of the furnace can be substantially identical with those of the furnace shown in FIGS. 1 and 2, so that some of such identical parts will be identified by the same reference numerals as used to denote the corresponding parts in FIGS. 1 and 2, only with the letter a suffixed to the numerals.

With particular reference to FIG. 12, the burner assembly 60 generally comprises a tubular stem 61 extending vertically through the distributor **16*a* for the delivery of a fuel-air mixture into the fluidized bed 17*a*, and a burner head 62 slidably fitted in the open end of the stem projecting into the fluidized bed. The burner stem 61 further extends downwardly through the bottom of the plenum chamber 19*a* and terminates in a closed end 63. A fuel-air conduit 64 is connected to the downwardly projecting end of the burner stem 61 for feeding the fuel-air mixture into the burner stem in the manner previously set forth in connection with FIG. 2**.

As will be noted from its cross section shown in FIG. 13, the burner head 62 used in this particular embodiment is substantially of the type shown in FIGS. 3 and 4. The burner head 62 comprises a disc-like bottom plate 65 having a hole 66 formed centrally therein a conical top cover 67 having a downturned annular rim 68, and a plurality of baffle plates 69 of generally annular arrangement extending vertically between the bottom plate 65 and the top cover 67. The baffle plates 69 are disposed at constant space intervals around a circle coaxial with the burner head 62 to define lateral outlet openings for ejection of the fuel-air mixture. Further, the baffle plates 69 are all oriented at a preassigned angle relative to respective radial directions of the burner head to impart a swirl to the jets of fuel-air mixture discharged from the head.

The construction of the burner head for use in the arrangement of FIG. 12 is not limited to the one illustrated. According to one possible alternative construction, the burner head is in the form of a hollow cylinder having a multiplicity of holes of suitable size and placement formed in its surface.

The burner head 62 of the exemplified construction at its bottom plate 65 is connected via a connector 70 to the top end of an actuator rod 71 coaxially received in the burner stem 61. Projecting downwardly out of the closed end 63 of the burner stem 61, the other end of the actuator rod 71 is rotatably journaled in a bearing block 72. The actuator rod 71 is screw threaded at 73 to mesh with the corresponding internal thread of a guide sleeve 74 formed integral with the end 63 of the burner stem 61. A worm wheel 75 mounted on the actuator rod 71 by spline engagement meshes with a worm 76 on the output shaft 77 of a reversible motor 78. By the rotation of this motor 78, therefore, the burner head 62 can be adjustably moved up and down relative to the burner stem 61. Alternatively, the actuator rod 71 may be moved directly by a fluid actuated cylinder.

During the normal operation of the fluidized-bed furnace the burner head 62 is held in a working position as shown in FIG. 12, introducing the swirling jets of fuel-air mixture into the fluidized bed **17*a* with suitable velocity. Upon decrease, for example, in the supply rate of the fuel to be burnt, the feed rate of the fuel-carrying air may be correspondingly decreased. Simultaneously, the motor 78 may be set into rotation in the direction to cause descent of the burner head 62 into the burner stem 61, thereby causing a decrease in the total effective area of the outlet openings of the burner head 62**.

The motor 78 is stopped when the total effective area of the burner head openings decreases to such an extent that the velocity of the fuel-air mixture jets issuing therefrom remains unvaried in spite of the decreased feed rate of the fuel-carrying air. It is thus possible to keep constant the discharge velocity of the fuel-air mixture from the burner head 62 despite variations in the feed rate of the mixture.

Upon completion of a desired run of the furnace, or when the supply of the fuel-carrying air must be suspended owing to some such trouble as the clogging of the fuel conduit, the motor 78 is operated to cause full descent of the burner head 62 into the burner stem 61 as shown in FIG. 14. In this lowermost or retracted position of the burner head 62 its outlet openings are completely closed by the burner stem 61, and, further, the downturned rim 68 of its top cover 67 fits over the burner stem. The fluid particles are thus prevented from falling into the burner head 62 or into the burner stem 61.

Although the present invention has been shown and described as adapted for a fluidized-bed furnace or incinerator, the invention is, of course, applicable to other forms of fluidized-bed combustion apparatus. It is further understood that the detailed description hereinabove presented is by way of example only, since changes or modifications will readily occur to those skilled in the art. For example, in the illustrated construction of the fluidized-bed furnace, the distributor may not necessarily be perforated as shown, for the fluidizing air could be introduced into the fluidized bed through suitable nozzles extending through the distributor.

What is claimed is:

1. A method of supplying a fuel into a fluidized bed combustion apparatus of the type having a bed of solid particles formed on an air distributor, which method comprises:

(a) feeding fluidizing air into the bed through the the distributor to fluidize the bed;

(b) simultaneously feeding a mixture of a fuel and fuel-carrying air into the fluidized bed, the mass ratio of the feed rate of the fuel-carrying air to the sum of the feed rates of the fluidizing air and the fuel-carrying air being adjusted to be in the range of from about 0.2 to about 0.6; and (c) introducing the mixture of the fuel and fuel-carrying air into the fluidized bed in the form of swirling jets from a burner head.

2. A fluidized-bed combustion apparatus comprising an enclosure having an air distributor, a bed of solid particles overlying the distributor, means for feeding fluidizing air into the bed through the distributor to fluidize the bed, means for controlling the feed rate of the fluidizing air, means including a burner for feeding a mixture of a fuel and fuel-carrying air into the bed, and means for controlling the feed rate of the fuel-carrying air, said burner comprising a hollow stem extending upwardly through the distributor for the transfer of the fuel-air mixture and having one end located in the bed, and a head on said one end of the stem for introducing the fuel-air mixture into the bed, the improvement comprising the head of the burner including a hollow base placed in communication with the burner stem, a top cover, and a plurality of baffle plates of generally annular arrangement extending between the base and the top cover to define lateral outlet openings for ejection of the fuel-air mixture, each baffle plate being oriented at a specific angle relative to the radial direction of the burner head, whereby the fuel-air mixture is introduced into the bed in the form of swirling jets.

3. The fluidized-bed combustion apparatus as claimed in claim 2, wherein the base of the burner head is screw-threadedly engaged with the burner stem.

4. A fluidized-bed combustion apparatus comprising an enclosure having an air distributor, a bed of solid particles overlying the distributor, means for feeding fluidizing air into the bed through the distributor to fluidize the bed, means for controlling the feed rate of the fluidizing air, means including a burner for feeding a mixture of a fuel and fuel-carrying air into the bed, and means for controlling the feed rate of the fuel carrying air, said burner comprising a hollow stem extending upwardly through the distributor for the transfer of the fuel-air mixture and having one end located in the bed, and a head on said one end of the stem for introducing the fuel-air mixture into the bed, the improvement comprising a slidably fitted burner head in said one end of the burner stem, the burner head having a plurality of lateral outlet openings for ejection of the fuel-air mixture, and wherein the apparatus further comprises means for adjustably moving the burner head up and down relative to the burner stem, whereby the total effective area of the outlet openings of the burner head can be adjusted to the feed rate of the fuel-carrying air, and whereby the outlet openings of the burner head can be completely closed by the burner stem as required.

5. The fluidized-bed combustion apparatus as claimed in claim 4, wherein the burner head comprises a bottom plate having a hole formed therein, a top cover, and a plurality of baffle plates of generally annular arrangement extending between the bottom plate and the top cover to define the lateral outlet openings, each baffle plate being oriented at a specific angle relative to the radial direction of the burner head, whereby the fuel-air mixture is introduced into the bed in the form of swirling jets.

6. The fluidized-bed combustion apparatus as claimed in claim 4, wherein the top cover of the burner head has an annular rim projecting downwardly therefrom so as to fit over said one end of the burner stem when the burner head is moved fully down into the burner stem.

* * * * *